US005560258A

United States Patent [19]

Coffey et al.

[11] Patent Number: 5,560,258

[45] Date of Patent: Oct. 1, 1996

[54] RELEASE MECHANISM FOR USE WITH A REMOTE TOOL

[75] Inventors: William M. Coffey, Houston; Syed Z. Ali, Spring; Bob C. Hopkins, Houston, all of Tex.

[73] Assignee: FMC Corporation, Chicago, Ill.

[21] Appl. No.: 491,608

[22] Filed: Jul. 27, 1995

Related U.S. Application Data

[63] Continuation of Ser. No. 312,177, Sep. 26, 1994, abandoned, which is a continuation of Ser. No. 2,008, Jan. 8, 1993, abandoned.

[51] Int. Cl.[6] ..... F16C 1/10

[52] U.S. Cl. ..... 74/500.5; 74/501.5 R; 166/359

[58] Field of Search ..... 74/500.5–502.6; 166/359, 345, 342, 349; 285/24, 27

[56] References Cited

U.S. PATENT DOCUMENTS

| | | | |
|---|---|---|---|
| 3,302,709 | 2/1967 | Postlewaite | 166/342 X |
| 3,675,713 | 7/1972 | Watkins | 166/0.6 |
| 4,475,820 | 10/1984 | Mulligan | 74/502.5 |
| 4,494,417 | 1/1985 | Larson et al. | 74/502.5 |
| 4,712,969 | 12/1987 | Kimura | 74/500.5 X |
| 4,823,879 | 4/1989 | Brammer et al. | 166/349 X |
| 4,955,384 | 9/1990 | Taylor et al. | 74/502.5 |
| 5,092,194 | 3/1992 | Oliver et al. | 74/500.5 |
| 5,133,727 | 7/1992 | Bales et al. | 74/500.5 X |
| 5,159,849 | 11/1992 | Womack | 74/502.3 |
| 5,246,075 | 9/1993 | Caulfield | 166/349 X |

FOREIGN PATENT DOCUMENTS

| | | | |
|---|---|---|---|
| 966363 | 10/1982 | U.S.S.R. | 74/502.5 |
| 883661 | 12/1961 | United Kingdom | 74/502.5 |
| 884516 | 12/1961 | United Kingdom | 74/502.5 |

*Primary Examiner*—Vinh T. Luong
*Attorney, Agent, or Firm*—Henry C. Query, Jr.

[57] ABSTRACT

A release assembly for operating a remote mechanism such as a subsea well connector includes a funnel-shaped body adapted to engage the well connector and a movable arm adapted to engage and disengage a locking cap of the well connector and provide lifting force in order to actuate the locking cap.

1 Claim, 4 Drawing Sheets

RELEASE MECHANISM FOR USE WITH A REMOTE TOOL

BACKGROUND OF THE INVENTION

This is a continuation of abandoned U.S. patent application Ser. No. 08/312,177 filed on Sep. 26, 1994, which is a continuation of abandoned U.S. patent application Ser. No. 08/002,008 filed on Jan. 8, 1993. This invention rotates to a mechanical system used to establish a structural connection between a remote tool and remote mechanisms. More specifically, the invention provides means for establishing a connection between a remote tool and a subsea well structure so that mechanisms on the well structure can be maintained or operated.

In the subsea oil industry, oil production operations are often carried out at the surface of the ocean floor at depths or under conditions that are unsuitable for divers. These operations—drilling, completion, installation, production, and service—are carried out from platforms or barges located above the ocean floor using remote systems that do not require divers.

A specific operation involves mechanically releasing hydraulic connectors being used for subsea christmas tree and tree cap connections. The mechanical release of such connectors requires the exertion of large force upon a connector unlocking mechanism. Prior art devices for carrying out such operations from a remote location require posts or similar additional structures to be attached to a release plate in order to enable a remotely operated tool to engage and lift the plate. Other prior art devices include tree connector mechanisms attached to toggle mechanisms that require a remote tool with pistons to push the toggle mechanisms to unlock the connectors.

The above-mentioned prior art devices present problems because they involve complex structures requiring more parts which increases overall costs and potential for failure.

SUMMARY OF THE INVENTION

The present invention provides a reliable subsea remote release device for operating remote mechanisms including, for instance, mechanically releasing subsea hydraulic connectors that overcomes the above-mentioned problems. The release device of the present invention is capable of exerting a large force upon a connector locking mechanism and is constructed from few, easily manufactured parts.

The main components of the release device comprise an actuating piston and a release arm. The actuating piston and release arm form part of an actuating assembly which is brought into position so that the assembly will cause the release arm to operatingly engage a release lift plate for a tree cap on a tree cap assembly.

The release device enables the release arm to properly align with the release lift plate automatically. The release device can selectively lock or unlock from the release lift plate. Furthermore, the release device enables the use of a circular connector release lift plate which eliminates the need for aligning the release device and the lift plate in a particular angular orientation.

DESCRIPTION OF THE PREFERRED EMBODIMENT

Figure 1:
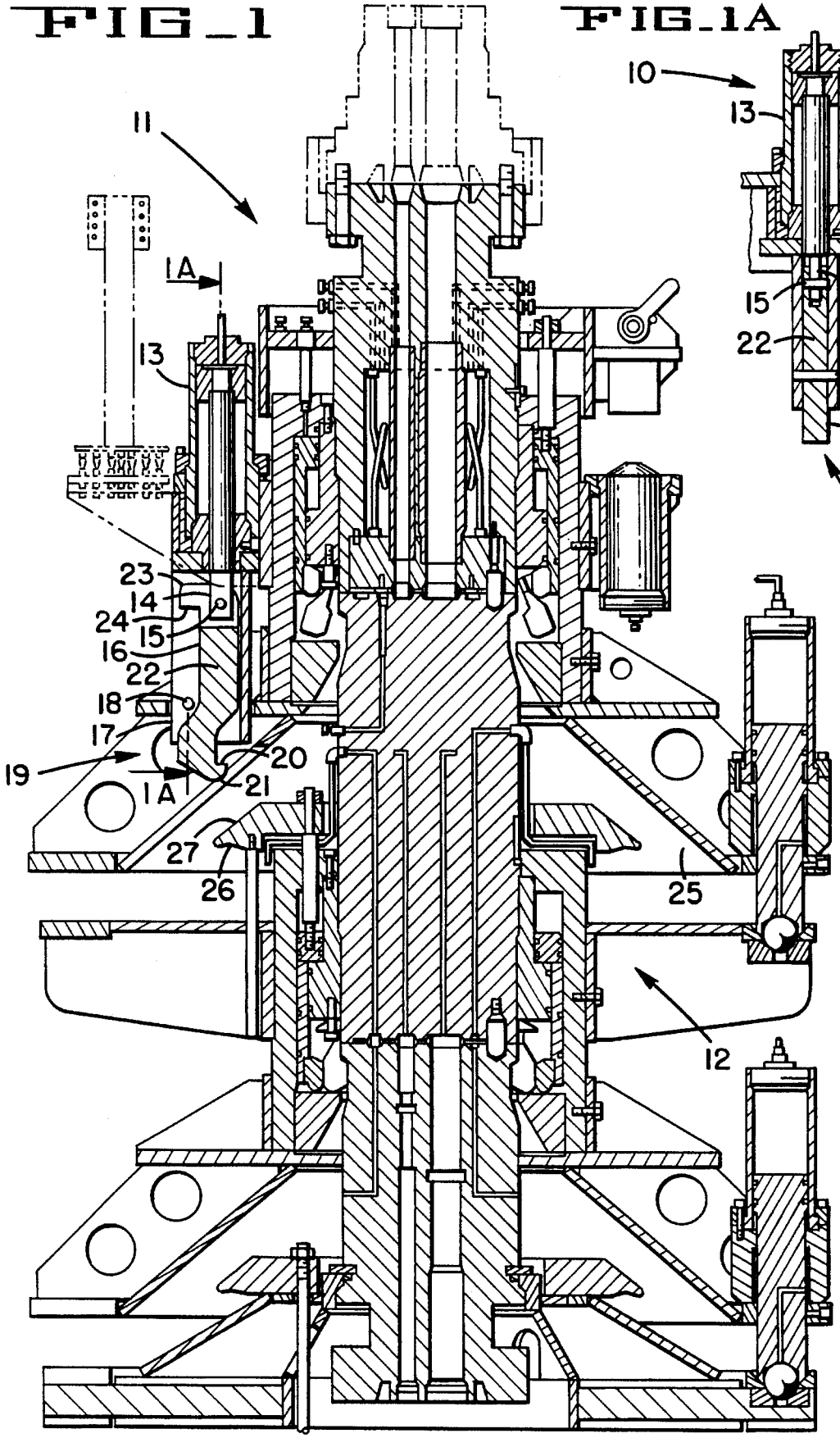
FIG. 1 is a sectional view of the release device mounted to a remote tool assembly which is in engagement with a tree cap assembly.
Figure 1A:
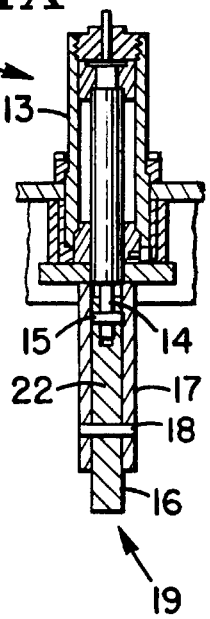
Figure 2:
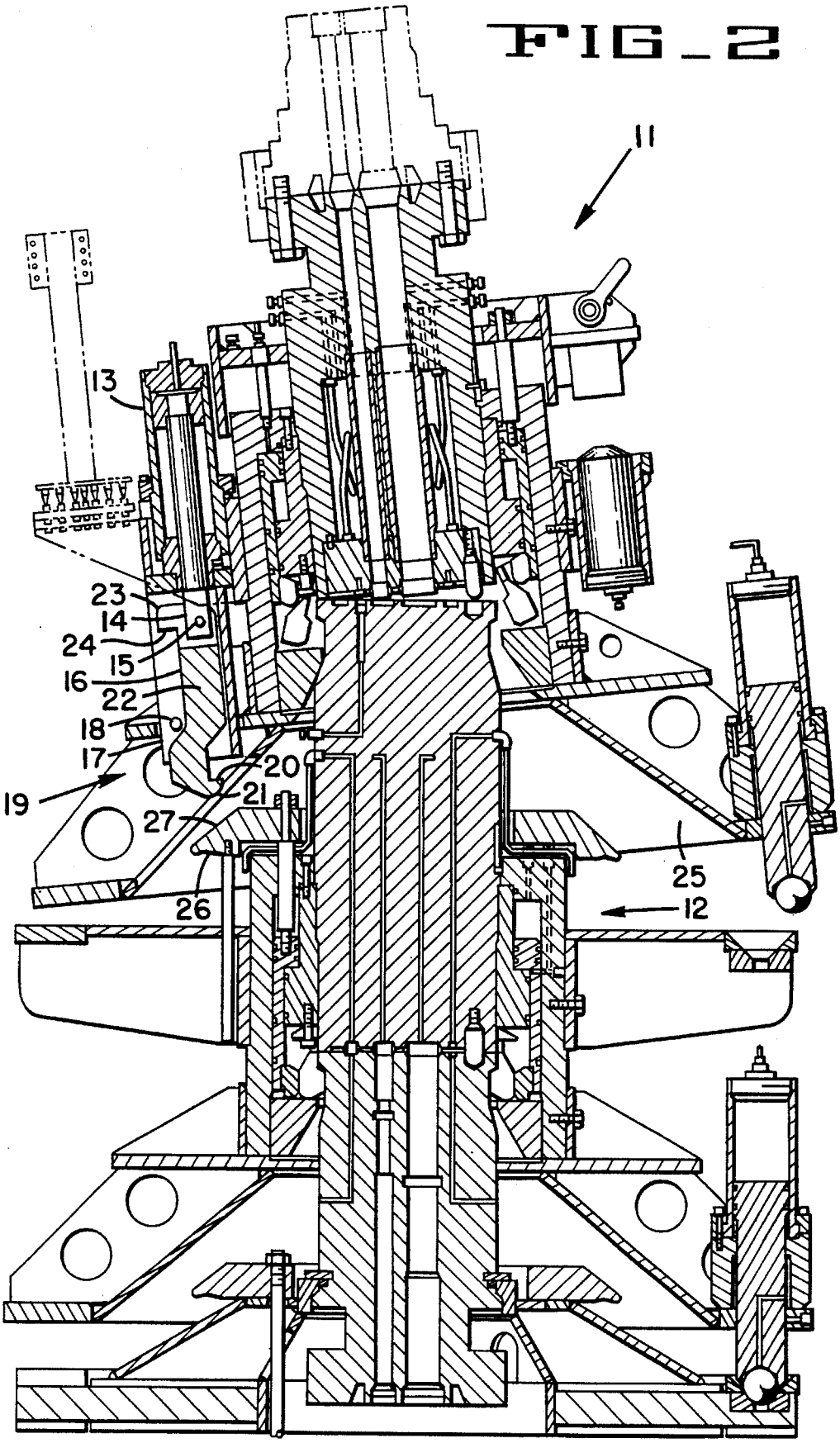
FIG. 2 is a sectional view of the release device mounted to a remote tool assembly which is in a release position with respect to a tree cap assembly.

FIG. 1 shows a release device 10 mounted to a funnel-shaped tool body assembly 11 for engaging and manipulating a remote assembly. The remote tool assembly 11 is engaged with a tree cap assembly 12 so that operations requiring the remote tool assembly 11 can be carried out on the tree cap assembly 12. The release device 10 comprises a double-acting actuator assembly 13. The double-acting actuator assembly 13 comprises an ordinary piston-cylinder assembly generally known to those skilled in the art, which includes a cylinder housing for containing a pressurized medium and a piston therein. The double-acting actuator assembly 13 includes a piston rod 14. Pivotally attached at all times during the operation of the remote tool assembly 11 to the piston rod 14 by a first pin 15 is the release arm 16. The release device 10 further comprises side plates 17 which extend along opposite sides of the release arm 16 and support a second pin 18.

The release arm device 16 comprises a hook end 19, a lifting surface 20, a tip end surface 21, an elongated body section 22, an extending section 23, and a pin contact surface 24. The release arm device 16 is of such size and shape that when the piston rod 14 is in a retracted position the release arm device 16 is retracted such that no portion of the release arm device 16 extends past the inner funnel surface 25 of the funnel-shaped remote tool assembly 11, enabling clearance of the release arm 16 with respect to any part of the tree cap assembly 12 during engagement or disengagement.

When the units tool assembly 11 engages a tree cap or tree upper frame as shown in FIG. 1, the double-acting actuator assembly 13 can be activated to operate the release arm 16 to engage the underside a release lift plate 26 and apply an upward lifting force upon retraction of the piston rod 14. FIGS. 3–10 illustrate the motion of the release arm 16 during this sequence.

Figure 3:
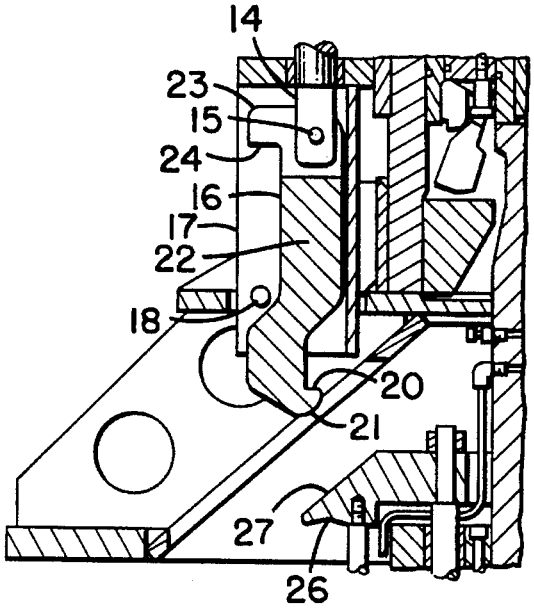
FIGS. 3–10 are fragmentary views showing the release arm of the release device in various sequential positions from a retracted position to engagement with a release lift plate.
Figure 4:
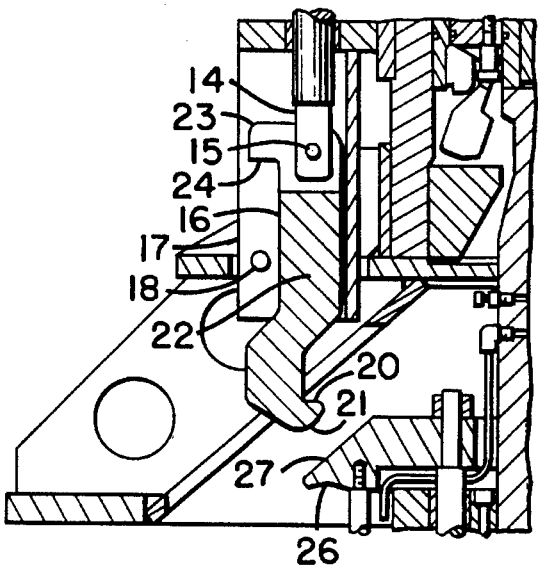
Figure 5:
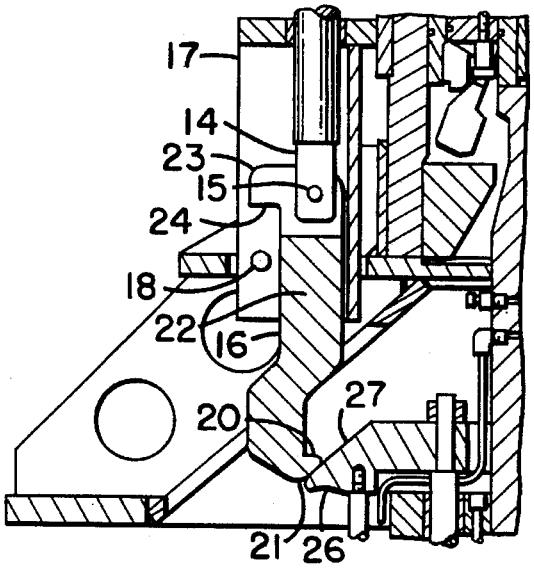
Figure 6:
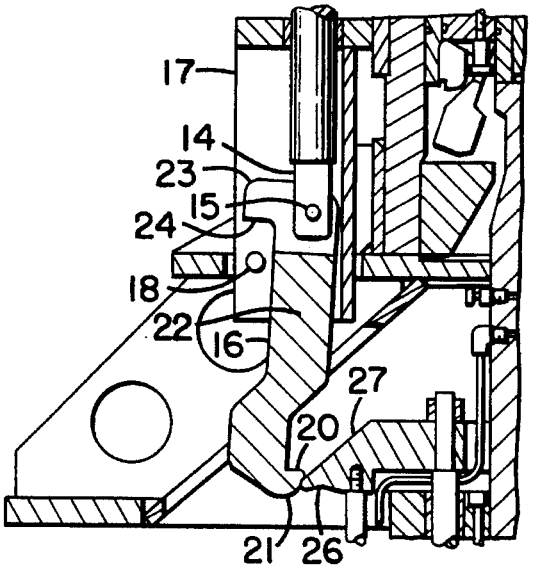
Figure 7:
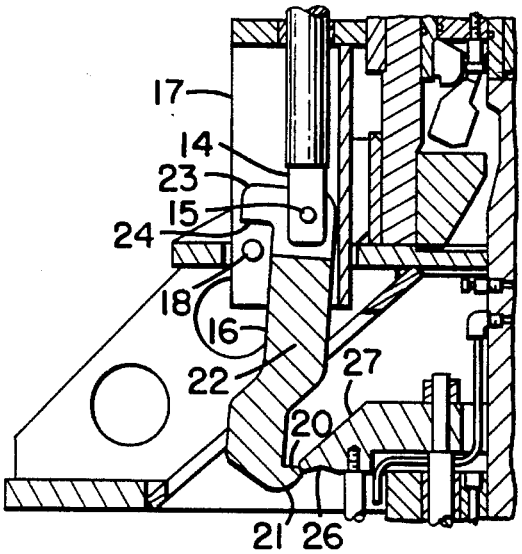
Figure 8:
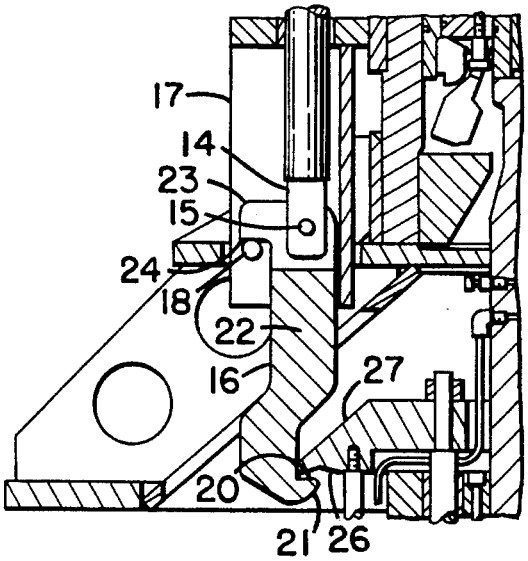
Figure 9:
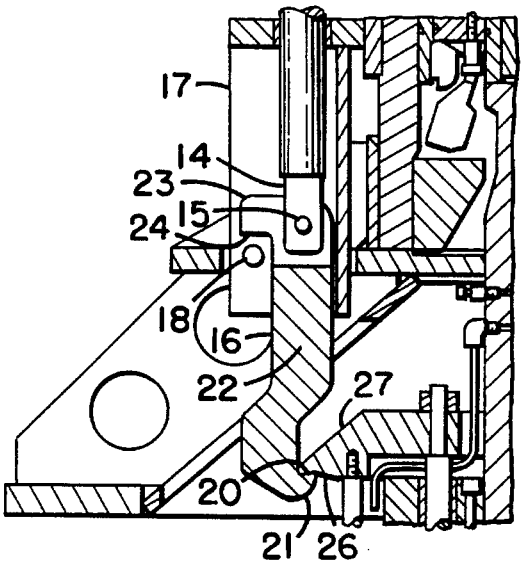
Figure 10:
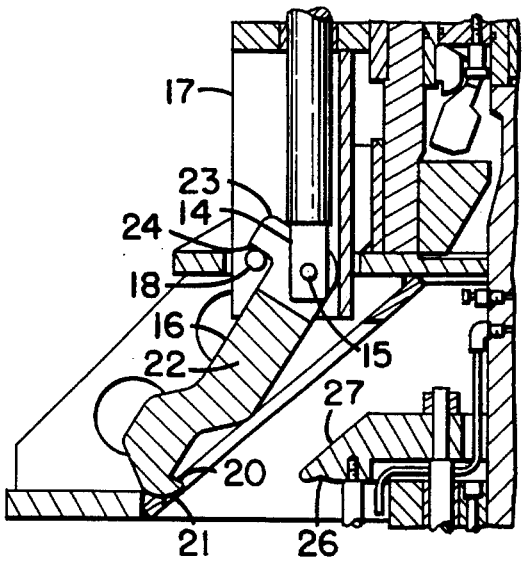

Initially, the release arm 16 is positioned as shown in FIG. 3, clear of the inner funnel surface 25 of the remote tool assembly 11. When the double-acting actuator assembly 13 is actuated, piston rod 14 is extended downward, lowering the release arm 16 past the inner funnel surface 25 tool toward release left plate 26 as shown in FIG. 4. As shown in FIG. 5, the piston rod 14 will advance the release arm 16 until the tip end surface 21 of the release arm 16 contacts a top, beveled outside diameter surface 27 of release lift plate 26. The downward motion of the piston rod 14 and release arm 16 continue so that the tip end surface 21 slides along the beveled surface 27 causing the release arm 16 to pivot about first pin 15, as shown in FIGS. 6–7. Once the tip end surface 21 has cleared the beveled surface 27, the release arm swings back, under gravity, to a piston as shown in FIG. 8. Next, the piston rod 14 is retracted so that lifting surface 20 is brought into contact with a lower portion of the release lift plate 26 as shown in FIG. 9. Applying further retraction force through piston rod 14 will lift release plate 26 for releasing the connection.

To disengage the release arm 16 from the release plate 26, the piston rod 14 is extended beyond the position shown in FIG. 8 so that the pin contact surface 24 of the extending portion 23 contacts second pin 18 causing the release arm to pivot about first pin 15 in a direction away from release plate 26.

Although the best mode contemplated for carrying out the present invention has been herein shown and described, it will be apparent that modification and variation may be made without departing from what is regarded to be the subject matter of the invention.

We claim:

1. A release assembly for operating a remote mechanism, wherein the release assembly comprises:

a funnel-shaped body adapted to engage said remote mechanism;

a release arm adapted to be movably mounted on said body;

said release arm having a first end and a second end;

said release arm connected at said first end to means for moving said release arm relative to said body;

said second end of said release arm having means for engaging said remote mechanism;

said means for moving said release arm being moveable to transmit forces through said release arm to actuate said remote mechanism;

said release arm comprises means for pivotally receiving a pin at said first end, whereby said release arm is pivotally connected to said means for moving said release arm, and a central, longitudinal axis extending between said first end and said second end;

said means for engaging said remote mechanism comprise a hook-shaped portion at said second end having a lifting surface forming a plane perpendicular to said longitudinal axis and facing said first end;

said means for moving said release arm comprise a piston-cylinder assembly including a piston having a piston rod extending therefrom, and a cylinder housing said piston, whereby upon the introduction of a pressurized medium within said cylinder, said piston and said rod reciprocate causing said release arm to move relative to said cylinder; and said hook-shaped portion further comprises a tip end surface adjacent to said lifting surface and facing opposite said lifting surface, said tip end surface having a planar portion extending angularly in relation to said plane formed by said lifting surface;

said means for moving said release arm further comprise an extended section extending from said first end of said release arm in a direction perpendicular to said longitudinal axis;

said extended section comprises a pin contact surface forming a plane perpendicular to said longitudinal axis and facing said second end;

said pin contact surface is adapted to engage a pin member fixed relative to said cylinder when said piston rod extends from said cylinder, thereby causing partial rotation of said release arm;

said means for moving said release arm further comprise a pair of side plates each, respectively, extending from said cylinder on opposite sides of said release arm; and said pin member is affixed in between said side plates.

* * * * *